US005531376A

United States Patent [19]

Brink et al.

[11] Patent Number: 5,531,376

[45] Date of Patent: Jul. 2, 1996

[54] PAPERBOARD CONTAINER WITH INTEGRAL PAPERBOARD POUR SPOUT

[75] Inventors: Thomas J. Brink, Kentwood; James L. Stone, Grand Rapids, both of Mich.

[73] Assignee: Packaging Corporation of America, Evanston, Ill.

[21] Appl. No.: 514,913

[22] Filed: Aug. 14, 1995

[51] Int. Cl.[6] ..... B65D 5/74

[52] U.S. Cl. ..... 229/215; 229/207; 229/221

[58] Field of Search ..... 229/207, 215, 229/217, 221, 125.42

[56] References Cited

U.S. PATENT DOCUMENTS

| | | | |
|---|---|---|---|
| 2,885,933 | 5/1959 | Phillips . | |
| 2,903,175 | 9/1959 | Peimer . | |
| 3,133,689 | 5/1964 | Rossi . | |
| 3,184,137 | 5/1965 | Mohler . | |
| 3,185,377 | 5/1965 | Moore . | |
| 3,187,977 | 6/1965 | Graybill . | |
| 3,187,978 | 6/1965 | Graybill . | |
| 3,289,913 | 12/1966 | Suensson | 229/217 |
| 3,344,972 | 10/1967 | Robinson et al. | 229/215 |
| 3,362,612 | 1/1968 | Mohler | 229/215 |
| 3,568,910 | 3/1971 | McConnell | 229/125.42 |
| 4,317,518 | 3/1982 | Mode | 229/207 |
| 4,809,853 | 3/1989 | Weber . | |
| 4,909,395 | 3/1990 | Weissman . | |
| 4,944,406 | 7/1990 | Zehnal | 229/207 |
| 4,967,910 | 11/1990 | Schuster . | |
| 5,014,888 | 5/1991 | Bryan . | |
| 5,035,330 | 7/1991 | Kuchenbecker | 229/207 |
| 5,169,059 | 12/1992 | Desmond et al. | 229/215 |
| 5,259,552 | 11/1993 | Kuchenbecker | 229/207 |
| 5,429,297 | 7/1995 | Walsh | 229/215 |

FOREIGN PATENT DOCUMENTS

| | | | |
|---|---|---|---|
| 606816 | 10/1960 | Canada | 229/207 |
| 92953 | 5/1962 | Denmark | 229/215 |
| 3832544 | 3/1990 | Germany | 229/215 |
| 1275802 | 5/1972 | United Kingdom | 229/207 |

*Primary Examiner*—Gary E. Elkins
*Attorney, Agent, or Firm*—Arnold, White & Durkee

[57] ABSTRACT

A paperboard container composed of a unitary, continuous blank, comprises opposing top and bottom walls, a plurality of side walls bridging the top and bottom walls, an upper minor flap, and a paperboard pour spout. The plurality of side walls includes a first side wall having upper and lower ends. The upper minor flap extends from the upper end of the first side wall, and the upper minor flap forms a portion of the top wall. The pour spout includes a spout body and a pair of spout wings hingedly connected to opposing edges of the spout body. The pour spout is pivotally coupled to the first side wall for movement between closed and open positions. The spout wings extend into the container via an opening in the first side wall. The pour spout further includes a backboard hingedly connected to the upper minor flap and adhered to an inner surface of the first side wall. The backboard partially overlaps the spout body. The spout wings form respective bumps at locations immediately adjacent to an upper edge and respective ones of the opposing edges of the spout body. The backboard forms a pair of shoulders which releasably engage the respective bumps. The spout wings form a pair of die-cut stops which project in generally opposite directions from respective ones of the opposing edges of the spout body. The stops are generally coplanar with the spout body.

9 Claims, 7 Drawing Sheets

PAPERBOARD CONTAINER WITH INTEGRAL PAPERBOARD POUR SPOUT

FIELD OF THE INVENTION

The present invention relates generally to paperboard containers and, more particularly, relates to a paperboard container having an integrally formed paperboard pour spout.

BACKGROUND OF THE INVENTION

Pour spouts are employed on containers to dispense various types of products, including, but not limited to, granular products (e.g., pet litter, laundry detergent, dish-washing detergent, etc.), rice, cereal, dry pet food, and gun pellets. Although metal and plastic pour spouts have been applied to containers for many years, the application of such metal and plastic spouts is costly because the spouts require special and expensive application equipment and cause decreased assembly line efficiencies.

In an effort to reduce the costs associated with the application of pour spouts to containers, pour spouts composed of paperboard have been introduced to the marketplace in recent years. Heretofore, the, effectiveness of such paperboard pour spouts has been limited by such problems as lack of durability, the absence of tactile or audible feedback indicative of positive reclosure,, and the inability to prevent spillage or sifting of the contents of the container in the area of the pour spout. Despite attempts to reduce the cost of paperboard pour spouts relative to the costs of metal and plastic pour spouts, such paperboard pour spouts have nonetheless been fairly costly due to their use of excessive amounts of paperboard.

Accordingly, a need exists for a paperboard pour spout which overcomes the above-noted shortcomings associated with existing pour spouts.

SUMMARY OF THE INVENTION

In one particular embodiment of the present invention, a paperboard container composed of a unitary, continuous blank, comprises opposing top and bottom walls, a plurality of side walls bridging the top and bottom walls, an upper minor flap, and a paperboard pour spout. The plurality of side walls includes a first side wall having upper and lower ends. The upper minor flap extends from the upper end of the first side wall, and the upper minor flap forms a portion of the top wall. The pour spout includes a spout body and a pair of spout wings hingedly connected to opposing edges of the spout body. The pour spout is pivotally coupled to the first side wall for movement between closed and open positions. The spout wings extend into the container via an opening in the first side wall.

In one embodiment, the pour spout further includes a backboard hingedly connected to the upper minor flap and adhered to an inner surface of the first side wall. The backboard partially overlaps the spout body.

In another embodiment, the spout wings form respective bumps at locations immediately adjacent to an upper edge and respective ones of the opposing edges of the spout body. The backboard forms a pair of shoulders which releasably engage the respective bumps.

In yet another embodiment, the spout wings form a pair of die-cut stops which project in generally opposite directions from respective ones of the opposing edges of the spout body. The stops are generally coplanar with the spout body.

In a further embodiment, the first side wall includes a stationary portion and spout body reinforcing portion. The reinforcing portion is hingedly connected to and encompassed by the stationary portion. The reinforcing portion substantially overlaps and is adhered to the spout body such that the spout body and the reinforcing portion move in tandem with each other: between the closed position and the open position.

In yet a further embodiment, the reinforcing portion is detachably connected to the stationary portion prior to initially opening the pour spout. The first side wall includes a first cut score formed in an outer surface of the first side wall at a periphery of the reinforcing portion, and includes a second cut score formed in an inner surface of the first side wall. The second cut score is located inward of the periphery of the reinforcing portion and in proximity to the first cut score. The first and second cut scores form a rev cut such that initially opening the pour spout delaminates a paperboard section of the first side wall between the first and second cut scores.

BRIEF DESCRIPTION OF THE DRAWINGS

Other objects and advantages of the invention will become apparent upon reading the following detailed description and upon reference to the drawings in which.

Figure 1:
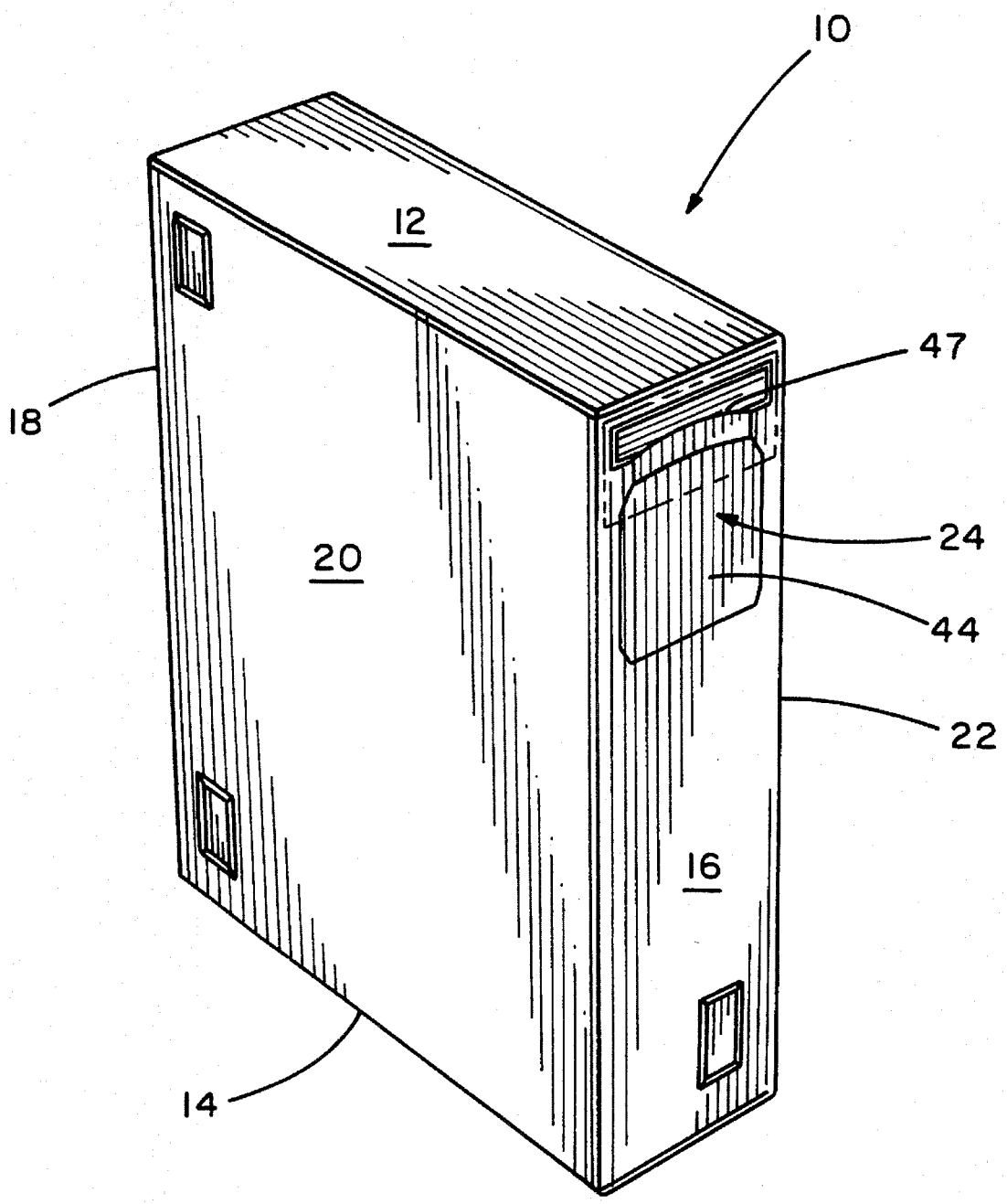
FIG. 1 is perspective view of a paperboard container embodying the present invention showing a paperboard pour spout in a closed position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 13:
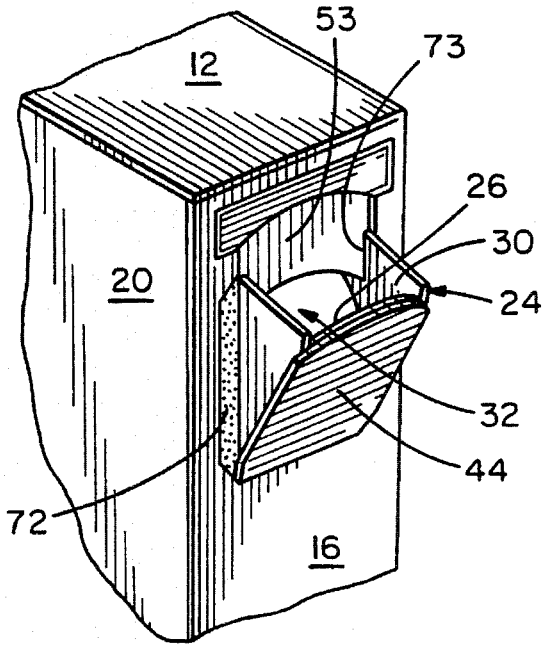
FIG. 13 is a partial perspective view of the paperboard container showing the paperboard pour spout in the open dispensing position as viewed from the exterior of the container.

Turning now to the drawings, FIG. 1 illustrates a paperboard container 10 formed from a unitary, continuous blank. The container 10 includes opposing top and bottom walls 12 and 14, four side walls 16, 18, 20 and 22 bridging the top and bottom walls 12 and 14, and a paperboard pour spout 24. The pour spout 24 is pivotally mounted to the side wall 16 for movement between a closed position (FIG. 1) and an open dispensing position (FIG. 13). As shown in FIG. 13, the pour spout 24 includes a spout body 26 and a pair of spout wings 28 and 30 hingedly connected to opposing edges of the spout body 26. The spout wings 28 and 30 extend into the interior of the container 10 via an opening 32 in the side wall 16.

Figure 2:
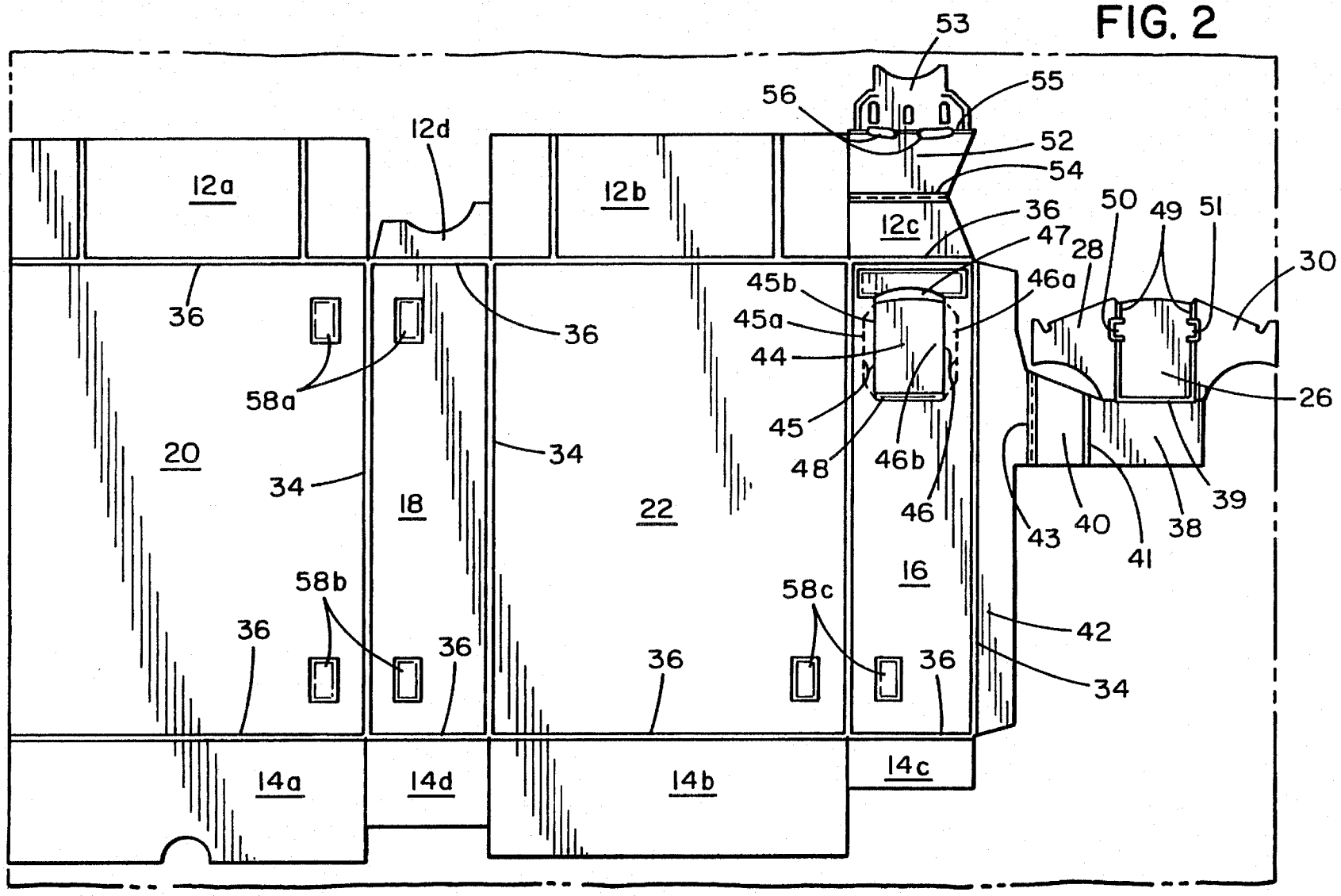
FIG. 2 is a plan view of an inside surface of a unitary, continuous blank used to form the paperboard container in FIG. 1.

FIG. 2 is a plan view of an inside surface of the unitary, continuous blank used to form the paperboard container 10 in FIG. 1. Identical reference numerals are used in FIGS. 1 and 2, as well as the remaining figures, to indicate corresponding portions of the blank and the paperboard container 10. The sheet of paperboard from which the blank is cut preferably has a thickness in a range between about 0.014 inches and about 0.026 inches. As viewed in FIG. 2, the blank includes four side wall panels 16, 18, 20 and 22 hingedly connected to each other along generally vertical fold lines 34. These side wall panels form the respective side walls of the paperboard container 10 in FIG. 1.

Figure 7:
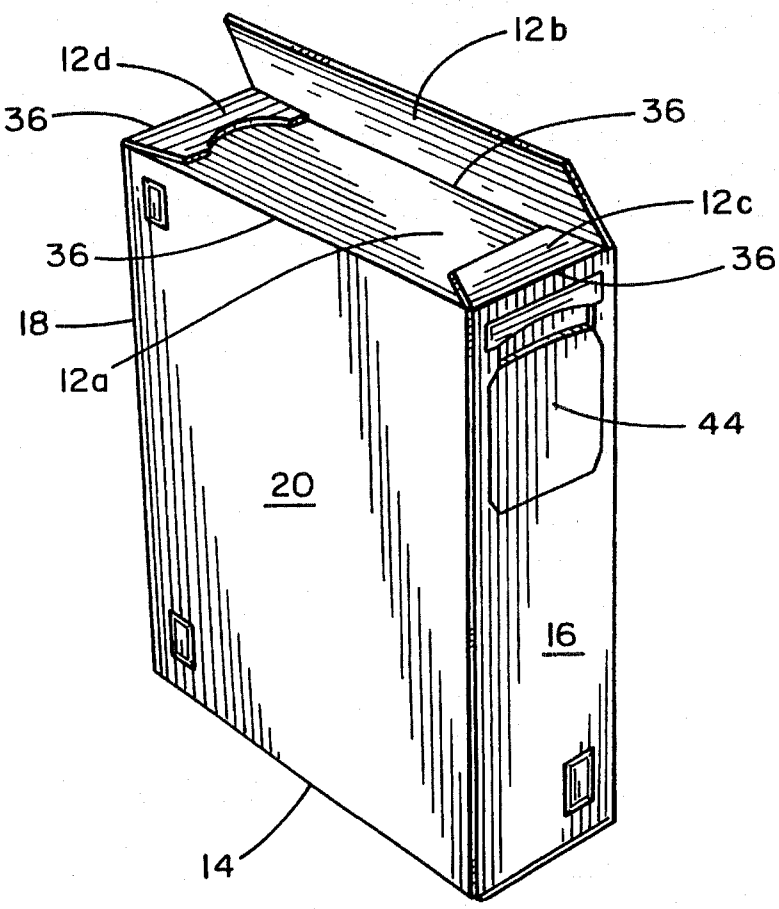
FIG. 7 is a perspective view showing the top closure flaps being folded to form the top wall of the paperboard container in FIG. 1.

A plurality of top and bottom closure flaps are hingedly connected to opposing upper and lower edges of the side wall panels 16, 18, 20 and 22 along generally horizontal fold lines 36. In particular, top major flaps **12*a* and 12*b* are hingedly connected to the upper edges of the respective side walls 20 and 22, and top minor flaps 12*c* and 12*d* are hingedly connected to the upper edges of the respective side walls 16 and 18. The top closure flaps 12*a*, 12*b*, 12*c* and 12*d* fold as shown in FIG. 7 to form the top wall 12 of the paperboard container 10. Similarly, bottom major flaps 14*a* and 14*b* are hingedly connected to the lower edges of the respective side walls 20 and 22, and bottom minor flaps 14*c* and 14*d* are hingedly connected to the lower edges of the respective side walls 16 and 18. The bottom closure flaps 14*a*, 14*b*, 14*c* and 14*d* fold in conventional fashion to form the bottom wall 14 of the paperboard container 10**.

Figure 3:
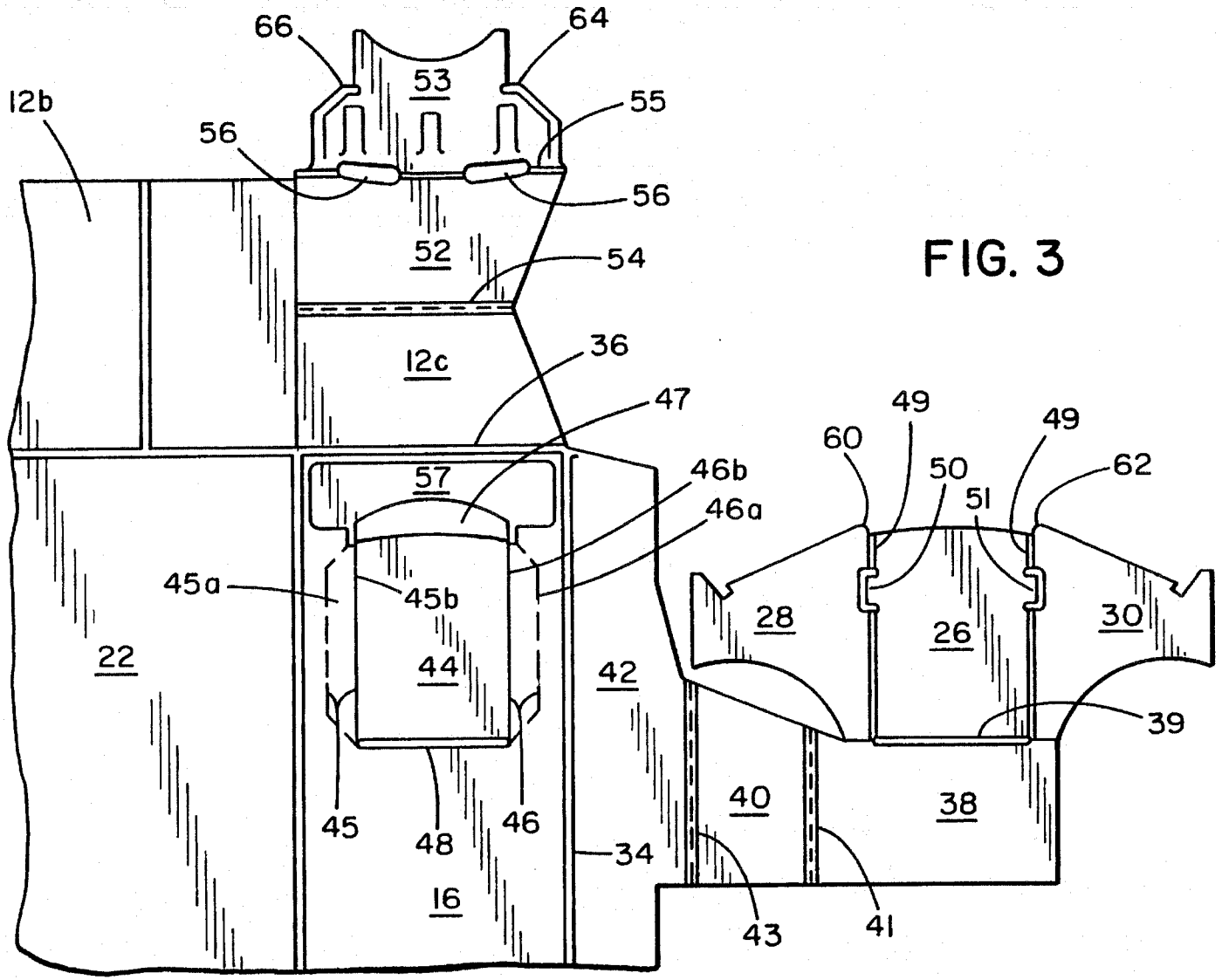
FIG. 3 is an enlarged plan view of a pour spout forming portion of the blank in FIG. 2.

Referring to FIGS. 2 and 3, the blank includes a plurality of pour spout panels coupled to the side wall panel 16 and used to form the pour spout 24 of the paperboard container 10. The spout body panel 26 is hingedly connected to an island panel 38 along a horizontal fold line 39, and the island panel 38 is in turn hingedly connected to an island span 40 along a vertical score line 41. The island span 40 is hingedly connected to a glue flap 42 along a vertical score line 43, and the glue flap 42 is in turn hingedly connected to the side wall 16 along the vertical fold line 34.

A spout body reinforcing panel 44 is created from the side wall 16 by means of a pair of vertical rev or reverse cuts 45 and 46, a cutout 47 elongated in the horizontal direction, and a horizontal fold line 48. Each rev cut consists of two generally parallel score lines located in close proximity to each other. The first score line is formed in the outer surface of the side wall 16, and the second score line is formed in the inner surface of the side wall 16 approximately one-eighth to one-quarter inch inside the first score line. Both the first and second score lines extend into the side wall 16 for a depth between about 30 and about 60 percent of the thickness of the side wall 16. The first score line is angled inward at its upper and lower ends so that it intersects the first score line. The rev cut 45 is formed from the first and second cut scores **45*a* and 45*b*, while the rev cut 46 is formed from the first and second cut scores 46*a* and 46*b*. The elongated cutout 47 bridges the upper ends of the cut scores 45*b* and 46*b*, while the horizontal fold line 48 bridges the lower ends of the cut scores 45*b* and 46*b*. The function of the rev cuts 45 and 46 is described below in connection with the description of the opening and closing of the pour spout 24**.

The pair of spout wing panels 28 and 30 are hingedly connected to opposing edges of the spout body panel 26 along vertical fold lines 49. FIG. 3 illustrates these spout wing panels 28 and 30 as being generally coplanar with the spout body 26. A pair of generally U-shaped stops 50 and 51 are die-cut into respective ones of the spout wing panels 28 and 30. The die-cut stops 50 and 51 project in generally opposite directions from respective fold lines 49.

As viewed in FIGS. 2 and 3, a backboard having a pair of backboard panels 52 and 53 extends upwardly from the top minor flap **12*c*. The backboard span 52 is hingedly connected to the top minor flap 12*c* along a horizontal score line 54, and the backboard panel 53 is hingedly connected to the backboard span 52 along a horizontal fold line 55. Cutouts 56 are formed along the fold line 55 to facilitate folding of the blank into the paperboard container 10 of FIG. 1**.

The formation of the backboard panels 52 and 53 by their connection to the top minor flap **12*c* is advantageous because it minimizes the amount of paperboard required to provide the pour spout 24 with a backboard. This paperboard minimization in turn reduces the cost of manufacturing the container 10 of FIG. 1. As described below, the backboard prevents the spout body 26 from collapsing into the container 10 upon closure of the pour spout 24. During the manufacture of the paperboard container 10, several paperboard blanks are simultaneously formed adjacent to one another from a sheet of paperboard. For example, the paperboard blank in FIG. 2 is formed adjacent to a second identical blank which is positioned above (or below) the blank in FIG. 2. If this second identical blank is positioned above the blank in FIG. 2, the lowermost edges of the bottom major flaps of the second blank (akin to flaps 14*a* and 14*b*) are immediately adjacent to the uppermost edges of the top major flaps 12*a* and 12*b*** of the blank in FIG.

To minimize the amount of paperboard scrap generated by die-cutting a sheet of paperboard into multiple adjacent blanks, it is desirable for portions of one blank to nest with portions of an adjacent blank. Such nesting occurs when the second identical blank described above is formed immediately above the blank in FIG. 2. Specifically, the backboard panel 53 is nested within a rectangular area unoccupied by the second blank. This unoccupied rectangular area is akin to the rectangular area immediately below the bottom minor flap **14*c* in FIG. 2. The reduction in paperboard scrap resulting from the nesting of adjacent blanks decreases the cost of manufacturing the paperboard container 10**.

Figure 4:
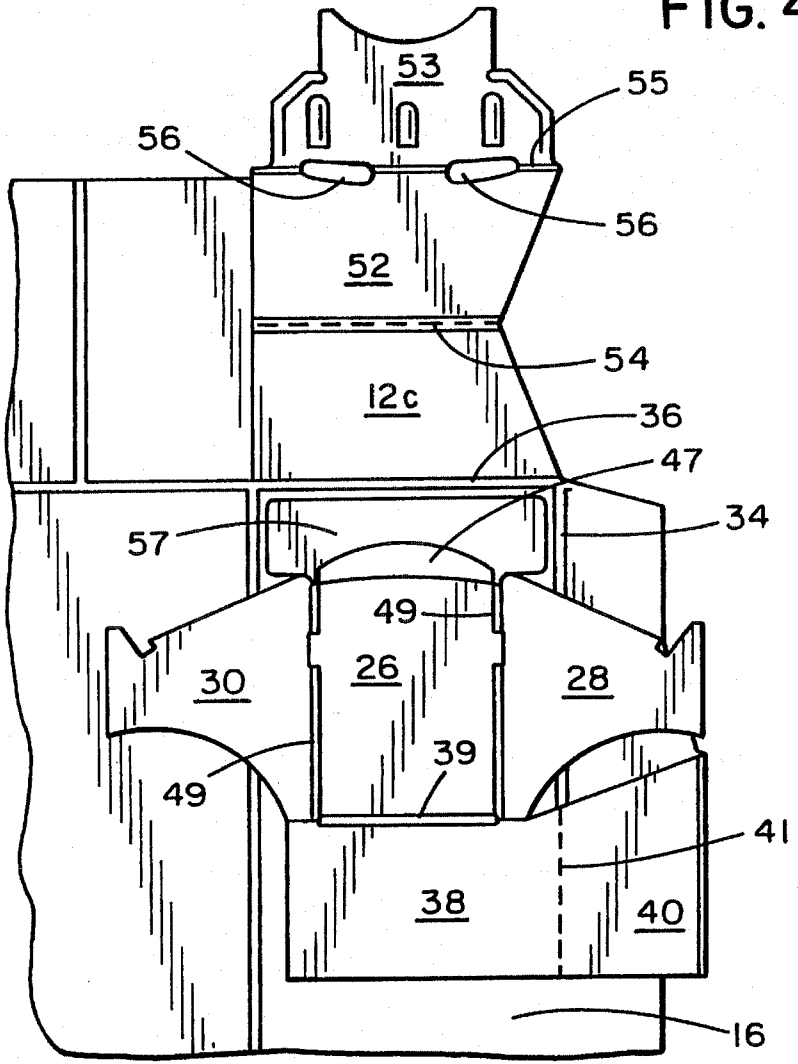

After the blank is formed, the blank is folded and glued to form the paperboard container 10. Referring to FIGS. 3 and 4, adhesive is applied to both the inner surface of the reinforcing panel 44 and the inner surface of the side wall panel 16 immediately below the reinforcing panel 44. To realize the partially folded blank in FIG. 4, the island span 40 is then rotated 180 degrees about the vertical score line 43 so that the inner surface of the spout body panel 26 is adhered to the inner surface of the reinforcing panel 44. Likewise, the inner surface of the island panel 38 is adhered to the inner surface of the side wall panel 16 immediately below the reinforcing panel 44. As best shown in FIG. 4, the spout body 26 substantially overlaps the hidden reinforcing panel 44 such that the fold line 39 is aligned with the hidden fold line 48 and the fold lines 49 are aligned with respective ones of the hidden score lines 45*b* and 46*b*. The upper edge of the spout body 26 is immediately below the elongated cutout 47. The score line 41 is aligned with the fold line 34.

Figure 5:
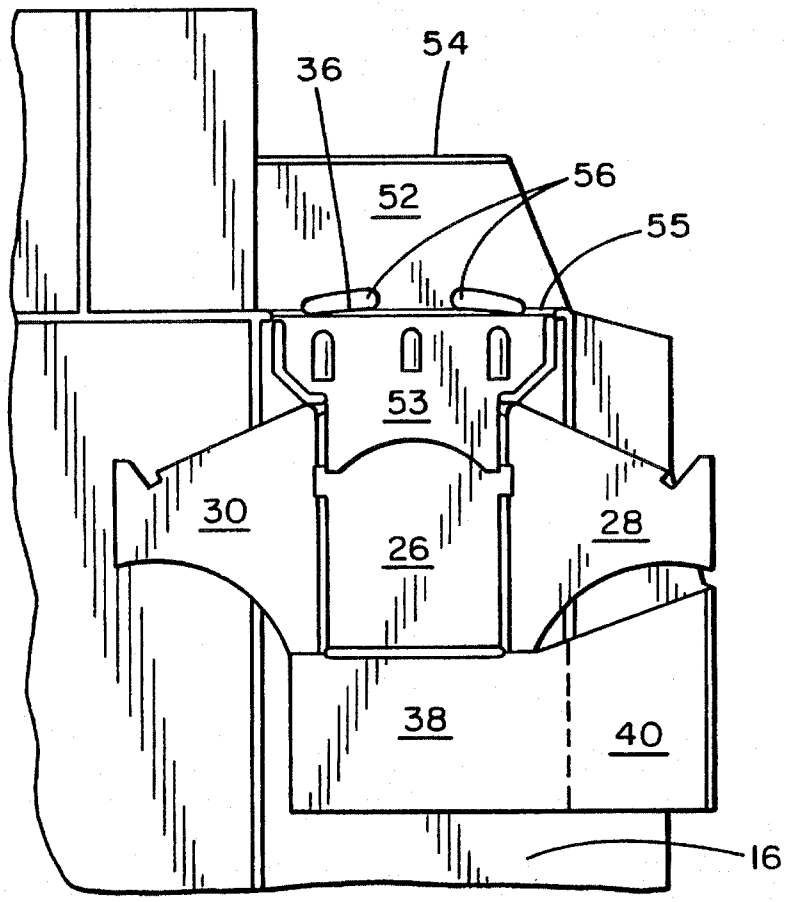
FIGS. 4 and 5 are enlarged plan views showing the sequence of folding the pour spout forming potion of the blank in FIG. 3 to form the paperboard pour spout.

Referring to FIGS. 4 and 5, adhesive is applied to a debossment region 57 located immediately above the elongated cutout 47. Adhesive may also be applied to the inner surface of the top minor flap 12*c*. To realize the blank confinguration in FIG. 5, the backboard span 52 is rotated 180 degrees about the horizontal score line 54 so that the inner surface of the backboard panel 53 is adhered to the debossment region 57. If adhesive is applied to the inner surface of the top minor flap 12*c*, the inner surface of the backboard span 52 is adhered to the inner surface of the top minor flap 12*c*. As best shown in FIG. 5, the fold line 55 is aligned with the fold line 36 connecting the minor flap 12*c* to the side wall 16. The cutouts 56 expose a portion of this fold line 36. Moreover, the backboard panel 53 covers the elongated cutout 47 and overlaps an upper portion of the spout body 26. In the area where the backboard panel 53 overlaps the spout body 26, the inner surface of the backboard panel 53 abuts the outer surface of the spout body 26.

Figure 6:
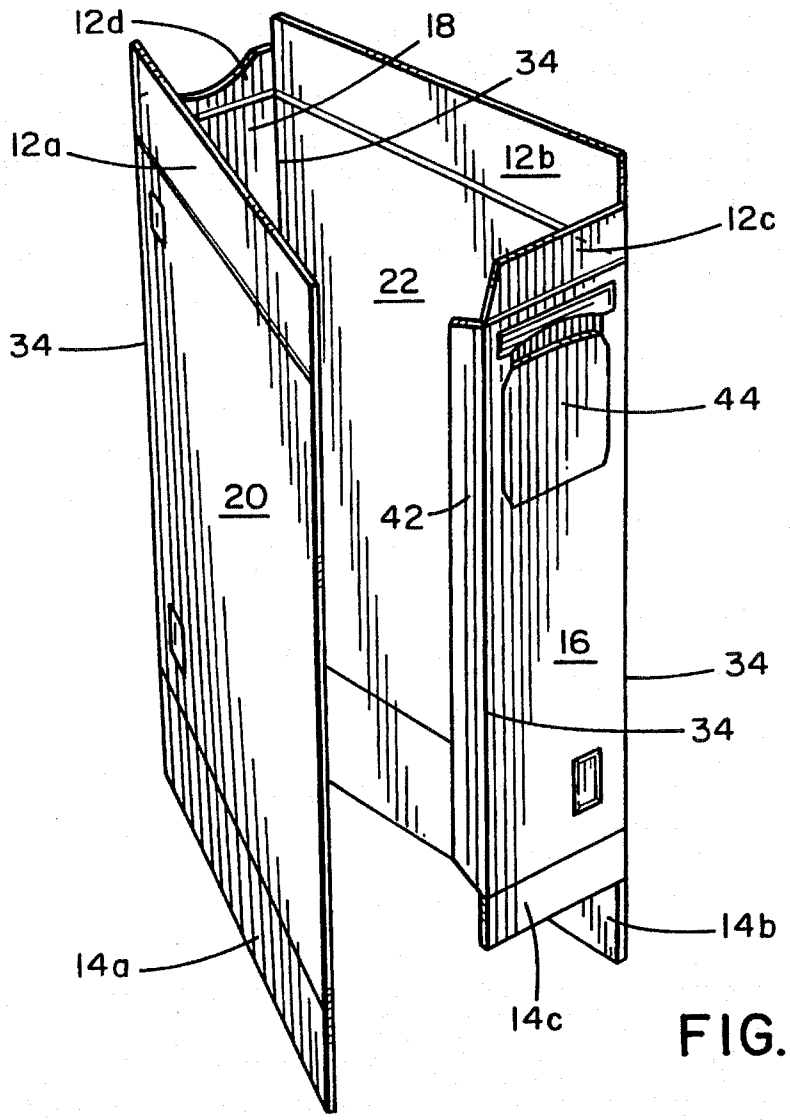
FIG. 6 is a perspective view showing the blank in FIG. 2 being folded into a tubular form after forming the paperboard pour spout.

After folding and gluing the pour spout panels as depicted in FIGS. 4 and 5, the blank is folded and glued in conventional fashion to form the paperboard container 10. Referring to FIG. 6, adhesive is applied to the outer surface of the glue flap 42. Next, the blank is folded about the vertical fold lines 34 to adhere the outer surface of the glue flap 42 to the inner surface of the side wall panel 20 along its free vertical edge. After the glue flap 42 is adhered to the side wall panel 20, the blank is in tubular form with open top and bottom ends.

Folding the blank into tubular form causes the spout wings 28 and 30 in FIG. 5 to rotate away from the side wall. 16 and out of the imaginary plane containing the spout body 26. Although the spout wings 28 and 30 bend relative to the spout body 26, the die-cut stops 50 and 51 continue to flare outwardly from the spout body 26 in the same plane as the spout body 26. The function of the die-cut stops 50 and 51 is described below in connection with the description of the opening and closing of the pour spout 24.

Typically, the blank in tubular form is flattened (not shown) to permit stacking of the blank in a case along with other identical flattened blanks by hand or by using high-speed case packing equipment. After the case is shipped to a customer for form-fill-seal operations, the blank in flattened tubular form is stacked once again with other such blanks in the hopper of the form-fill-seal equipment. The panels of the paperboard pour spout increase the thickness of the flattened tubular blank in the area of the pour spout panels. To counterbalance the increased thickness of the flattened tubular blank in the area of the pour spout panels, the blank in FIG. 3 is provided with three pairs of embossments 58*a*, 58*b* and 58*c*. The embossments in each pair are aligned with each other when the blank is in flattened tubular form. The embossments effectively increase the thickness of portions of the blank spaced away from the pour spout panels. When a plurality of flattened tubular blanks are stacked vertically or horizontally adjacent each other, the embossments bear against corresponding embossments of adjacent blanks to insure that the blanks will stack evenly without shingling or sagging.

The hopper of the form-fill-seal equipment delivers the flattened tubular blank to a machine which erects the flattened blank into a rectangular body with open top and bottom ends. One of the open ends is then sealed by appropriately folding and gluing the major and minor flaps of that end. For example, to realize the sealed bottom wall 14 in FIG. 7, the major and minor flaps of that bottom wall are folded and glued using a conventional flap folding sequence.

After sealing one end (e.g., the bottom end) of the paperboard container 10, the form-fill-seal equipment falls the container with a product via the open end (e.g., the top end) of the container. Referring to FIG. 7, the filled container is then sealed by appropriately folding and gluing the top major and minor flaps. In the preferred embodiment, the top major flap 12*a* is first folded inward about the associated fold line 36 so that it is substantially perpendicular to the side wall 20.

Next, the top minor flaps 12*c* and 12*d* are folded inward about the associated fold lines 36 so that they are substantially perpendicular to the respective side walls 16 and 18. Referring back to FIG. 5, since the fold line 55 connecting the backboard panels 52 and 53 is aligned with the fold line 36 connecting the top minor flap 12*c* to the side wall 16, folding the top minor flap 12*c* causes the backboard span 52 to rotate with the top minor flap 12*c* about the fold line 55 to a position substantially perpendicular to the side wall 16. The cutouts 56 facilitate the rotation of the backboard span 52 by preventing the paperboard from bunching or crimping along the aligned fold lines 55 and 36. Since the backboard span 52 substantially overlaps and is adhered to the top minor flap 12*c*, the backboard span 52 essentially serves as a part of the top minor flap 12*c*. Returning to FIG. 7, once the top minor flaps 12*c* and 12*d* are folded inward, the inner surface of the top minor flap 12*d* abuts the outer surface of the top major flap 12*a*. Also, due to the overlap of the backboard span 52 and the top minor flap 12*c*, the outer surface of the backboard span 52 abuts the outer surface of the top major flap 12*a*.

After applying adhesive to the outer surfaces of the inwardly-folded top flaps 12*a*, 12*c*, and 12*d*, the top major flap 12*b* is folded inward approximately 90 degrees about the associated fold line 36. The adhesive attaches the inner surface of the top major flap 12*b* to the outer surfaces of the flaps 12*a*, 12*c*, and 12*d*, thereby sealing the top wall 12 as depicted in FIG. 1.

The integral paperboard pour spout 24 will now be described in detail with reference to FIGS. 1 and 8–13. Referring first to FIGS. 1 and 8–10, there is shown the pour spout 24 in the closed position. Prior to initially opening the pour spout 24, the narrow strip of paperboard encompassed by the score lines of each of the rev cuts 45 and 46 (FIG. 3) is still intact. To prevent leakage of the container contents prior to initially opening the pour spout 24, a peelable label is preferably adhered to the side wall 16 to cover the cutout 47 in FIG. 1. The region of the side wall 16 occupied by the peelable label is indicated by the dotted lines in FIG. 1.

In the closed position of the pour spout 24, the spout wings 28 and 30 are fully disposed within the container 10.

The spout wings 28 and 30 form respective bumps 60 and 62 which, as best shown in FIG. 3, are located immediately adjacent to the respective fold lines 49. The bumps 60 and 62 are releasably engageable with respective shoulders 64 and 66 (FIGS. 3 and 8–10) formed by the backboard panel 53. When the pour spout 24 is in the closed position, the bumps 60 and 62 engage the respective shoulders 64 and 66 to assist in maintaining the pour spout in the closed position. FIG. 10 illustrates the engagement of the bump 62 and the shoulder 66.

Figure 8:
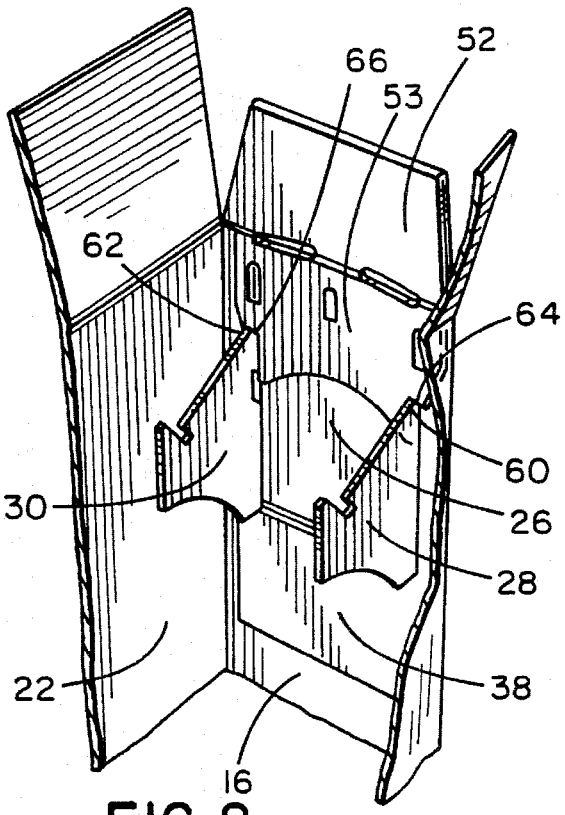
FIG. 8 is a partial perspective view of the paperboard container in FIG. 1 showing the paperboard pour spout in the closed position as viewed from the interior of the container.

To initially open the pour spout 24, a user first removes the peelable label described above. Next, the user inserts his or her finger(s) into the cutout 47 (FIGS. 1 and 10), engages the upper edges of the spout body 26 and reinforcing panel 44, and pulls outwardly on the spout body 26 and reinforcing panel 44. In response to the application of a sufficient amount of opening force, the bumps 60 and 62 in FIG. 8 are forced past the respective shoulders 64 and 66. Also, the strips of paperboard encompassed by the respective rev cuts 45 and 46 (FIG. 3) are delaminated into inner and outer layers to permit the pour spout 24 to be pivoted about the fold lines 39 and 48 (FIG. 12) to the open dispensing position. More specifically, the strip of paperboard between the cut scores **45*a* and 45*b* (FIG. 3) is delaminated into inner and outer layers. Similarly, the strip of paperboard between the cut scores 46*a* and 46*b* (FIG. 3) is delaminated into inner and outer layers. The inner layers remain attached to the main stationary portion of the side wall 16, while the outer layers are tom away from this main stationary portion and are carded with the reinforcing panel 44. FIG. 11 depicts a torn-away outer layer 70 of paperboard created by the rev cut 46 (FIG. 3), and FIG. 13 depicts the inner layer 72 of paperboard created by that rev cut 46**.

Figure 11:
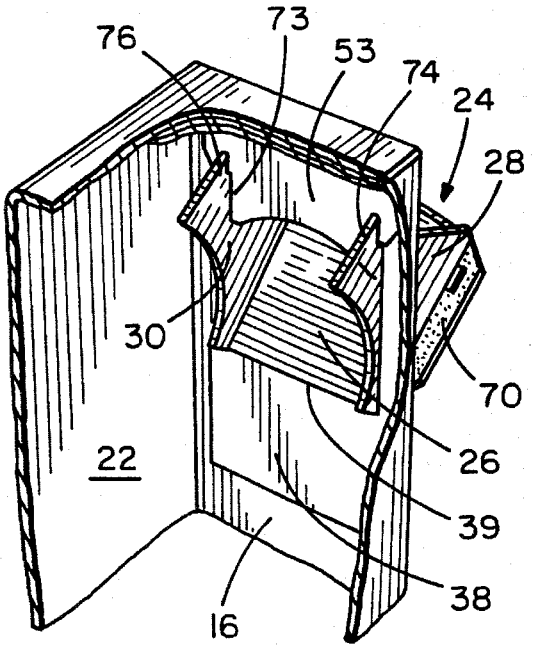
FIG. 11 is a partial perspective view of the paperboard container showing the paperboard pour spout in an open dispensing position as viewed from the interior of the container.
Figure 12:
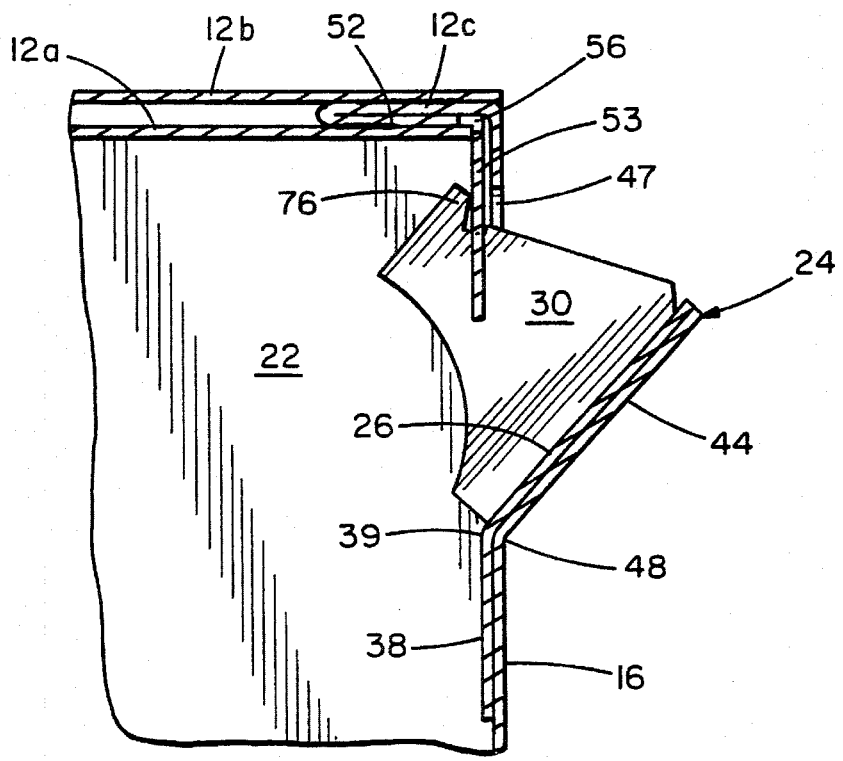
FIG. 12 is a sectional view similar to FIG. 10 but showing the paperboard pour spout in the open dispensing position.

FIGS. 11–13 depict the pour spout 24 in the open dispensing position. As the pour spout 24 is rotated to this open dispensing position, the spout wings 28 and 30 slide through respective vertical slits/notches formed adjacent to respective vertical edges of the backboard panel 53. The vertical edge adjacent to the slit associated with the spout wing 30 is designated by the reference numeral 73 in FIGS. 11 and 13. These slits serve to orient the spout wings 28 and 30 generally perpendicular to the spout body 26 as the pour spout 24 is opened. By orienting the spout wings 28 and 30 generally perpendicular to the spout body 26, the opening 32 in FIG. 13 is unobstructed. This unobstructed opening 32, in turn, permits the contents of the container 10 to be freely dispensed via the pour spout 24.

To strictly confine the pour spout 24 to the illustrated open position and prevent any movement beyond that open position, the spout wings 28 and 30 are provided with respective stoppers 74 and 76 (FIGS. 11 and 12). Once the pour spout 24 reaches the open position, the stoppers 74 and 76 contact the backboard panel 53.

Figure 9:
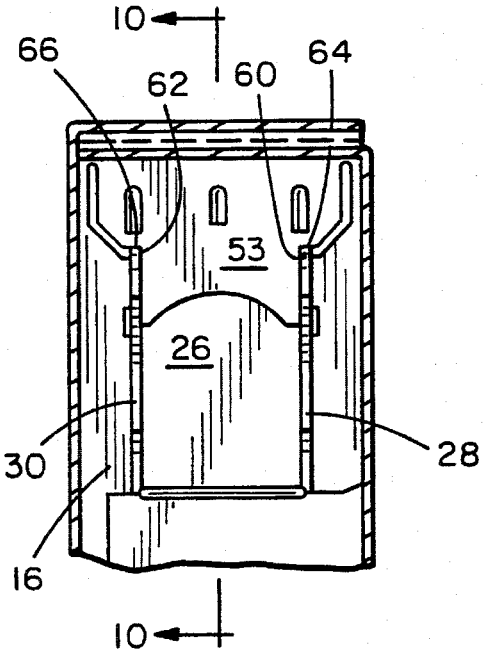
FIG. 9 is an elevational view of the paperboard pour spout in the closed position as viewed from the interior of the container in FIG. 1.
Figure 10:
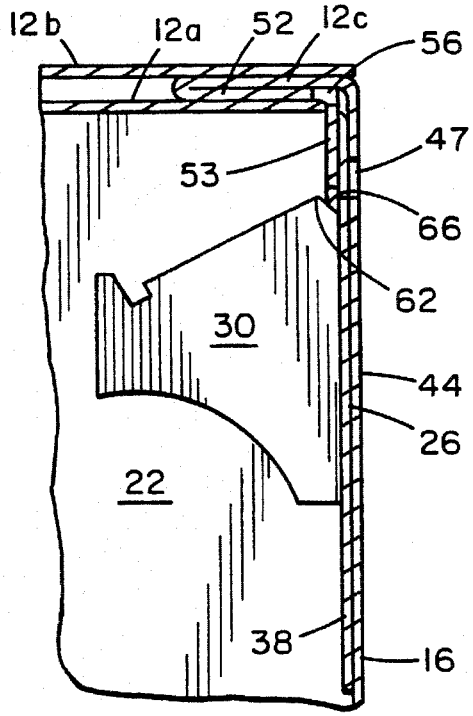
FIG. 10 is a sectional view taken generally along line 10—10 in FIG. 9.

After the user dispenses the desired amount of contents from the container 10, the pour spout 24 is reclosed to the closed position shown in FIGS. 8–10 by pushing inwardly on the reinforcing panel 44. To prevent the pour spout 24 from collapsing into the container 10 upon reclosure, inward rotation of the pour spout 24 is limited by the backboard panel 53, the inner layers formed by the rev cuts 45 and 46, and the U-shaped stops 50 and 51. Each of the foregoing elements assist in preventing rotation of the spout body 26 and reinforcing panel 44 beyond the closed position in FIGS. 8–10. When the spout body 26 and reinforcing panel 44 reach the dosed position, the spout body 26 contacts the backboard panel 53. Likewise, the inner surfaces of the outer layers formed by the rev cuts 45 and 46, as well as the inner surfaces of the U-shaped stops 50 and 51, contact the outer: surfaces of the associated inner layers. In addition to preventing the pour spout 24 from collapsing into the container 10, the delaminated paperboard strips formed by the rev cuts 45 and 46 provide the pour spout 24 with sift-resistance in proximity to the spout wings 28 and 30. The delaminated strips hinder the contained product from spilling out of the container 10 via the sides of the pour spout 24.

Reclosing the pour spout 24 leads to snap re-engagement of the bumps 60 and 62 and the respective shoulders 64 and 66. This snap re-engagement provides tactile and audible feedback indicative of effective reclosure of the pour spout 24. It has been determined in this regard that the presence of such tactile and audible feedback indicative of effective locking is desirable because the presence thereof provides consumers with a high "comfort" factor with respect to reclosure. Particularly in applications where the container 10 is used to house a product having a restricted storage life once the pour spout 24 has been initially opened, such positive feedback has been determined to provide an apparent sense of reassurance to consumers as to retention of "freshness", "safety", or scent of the contained product.

As stated in connection with FIG. 4, the reinforcing panel 44 substantially overlaps and is adhered to the spout body 26. Therefore, as the pour spout 24 is pivoted between the closed position and the open dispensing position, the spout body 26 and reinforcing panel 44 move in tandem with each other. The overlapping layers of paperboard provided by the spout body 26 and reinforcing panel 44 enhance the durability of the pour spout 24, thereby allowing the pour spout 24 to be repeatedly opened and closed without sustaining damage.

Figure 14:
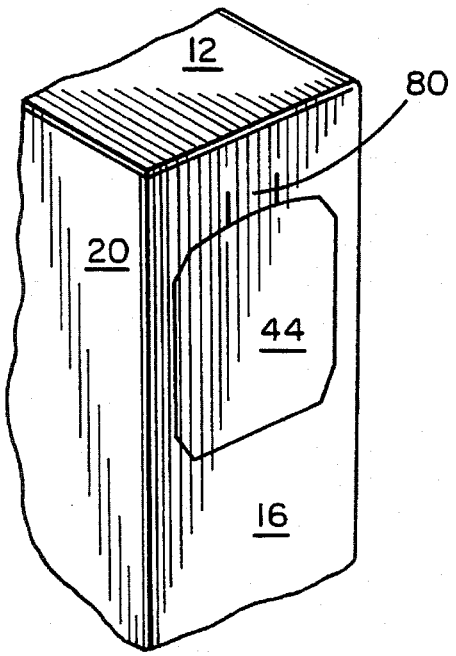
FIG. 14 is a partial perspective view of a paperboard container showing a modified paperboard pour spout, in accordance with the present invention, as viewed from the exterior of the container.

While the present invention has been described with reference to one or more particular embodiments, those skilled in the art will recognize that many changes may be made thereto without departing from the spirit and scope of the present invention. For example, the peelable label and underlying cutout 47 in FIG. 1 may be substituted with a deformable panel 80 located between a pair of spaced vertical cuts as depicted in FIG. 14. To open the pour spout the user presses the deformable panel 80 inward and then proceeds to pull outward on the spout body 26 and reinforcing panel 44 in the manner described previously. The modified embodiment in FIG. 14 is preferably used in applications where the contained product is less susceptible to sifting. Each of these embodiments and obvious variations thereof is contemplated as failing within the spirit and scope of the claimed invention, which is set forth in the following claims.

What is claimed is:

1. A paperboard container composed of a unitary, continuous blank, comprising:

opposing top and bottom walls and a plurality of side walls bridging said top and bottom walls, said plurality of side walls including a first side wall having upper and lower ends;

an upper minor flap extending from said upper end of said first side wall, said upper minor flap forming a nonion of said top wall; and a paperboard pour spout including a spout body and a pair of spout wings hingedly connected to opposing edges of said spout body, said pour spout being pivotally coupled said first side wall for movement between a closed position and an open dispensing position, said spout wings extending into the container via an opening in said first side wall, said pour spout further including a backboard hingedly connected to said upper minor flap and adhered to an inner surface of said first side wall, said backboard including a first section hingedly connected to said upper minor flap and having an inner surface adjacent to and substantially overlapping an inner surface of said upper minor flap, said backboard including a second section hingedly connected to said first section and adhered to the inner surface of said first side wall, said second section partially overlapping an upper portion of said spout body, said backboard forming a cutout between said first and second sections.

2. A paperboard container composed of a unitary, continuous blank, comprising:

opposing top and bottom walls and a plurality of side walls bridging said top and bottom walls, said plurality of side walls including a first side wall; and a paperboard pour spout including a spout body and a pair of spout wings hingedly connected to opposing edges of said spout body, said pour spout being pivotally coupled to said first side wall for movement between a closed position and an open dispensing position, said spout wings extending into the container via an opening in said first side wall, said spout wings forming respective bumps at locations immediately adjacent to an upper edge of said spout body and respective ones of said opposing edges of said spout body, said pour spout further including a backboard adhered to an inner surface of said first side wall and forming a pair of shoulders releasably engaging said respective bumps.

3. The paperboard container of claim 2, wherein said backboard and said first side wall form a pair of slits slidably receiving said respective spout wings, said shoulders being immediately adjacent to upper ends of said respective slits.

4. The paperboard container of claim 2, wherein said shoulders and said respective bumps are disposed in forcibly displaceable mutual engagement such that opening said pour spout exerts a force which disengages the mutual engagement between said shoulders and said respective bumps and reclosing said pour spout leads to snap reengagement of said shoulders and said respective bumps.

5. A paperboard container composed of a unitary, continuous blank, comprising:

opposing top and bottom walls and a plurality of side walls bridging said top and bottom walls, said plurality of side walls including a first side wall; and a paperboard pour spout including a spout body and a pair of spout wings hingedly connected to opposing edges of said spout body, said pour spout being pivotally coupled to said first side wall for movement between a closed position and an open dispensing position, said spout wings extending into the container via an opening in said first side wall, said pour spout further including a pair of die-cut stops formed from respective ones of said spout wings, said stops projecting in generally opposite directions from respective ones of said opposing edges of said spout body, said stops being generally coplanar with said spout body.

6. The paperboard container of claim 5, wherein said die-cut stops are generally U-shaped.

7. The paperboard container of claim 5, wherein said die-cut stops abut an outer surface of said first side wall at a periphery of said opening in said first side wall in response to movement of said pour spout to said closed position to prevent said pour spout from collapsing into the container.

8. A unitary, continuous paperboard blank for forming a container with a pour spout, the container having opposing top and bottom walls and a plurality of side walls bridging the top and bottom walls, the pour spout having a spout body and a pair of spout wings hingedly connected to opposing edges of said spout body, said blank comprising:

a plurality of side wall panels hingedly connected to each other along generally vertical fold lines, each of said plurality of side wall panels including opposing upper and lower edges, said plurality of side wall panels forming the plurality of side walls of the container, said plurality of side wall panels including a first side wall panel;

a plurality of top and bottom closure flaps hingedly connected to said opposing upper and lower edges of said plurality of side wall panels along generally horizontal fold lines, said plurality of top and bottom closure flaps forming the top and bottom walls of the container, said plurality of top and bottom closure flaps including a top minor flap hingedly connected to the upper edge of said first side wall panel; and a plurality of pour spout panels coupled to said first side wall panel, said plurality of pour spout panels including a spout body panel and a pair of spout wing panels hingedly connected to opposing edges of said spout body panel, said spout body panel and said pair of spout wing panels forming the respective spout body and the pair of spout wings of the pour spout, said plurality of pour spout panels further including a backboard hingedly connected to said top minor flap such that said backboard partially overlaps said spout body panel in response to folding the blank to form the container.

9. A unitary, continuous paperboard blank for forming a container with a pour spout, the container having opposing top and bottom walls and a plurality of side walls bridging the top and bottom walls, the pour spout having a spout body and a pair of spout wings hingedly connected to opposing edges of said spout body, said blank comprising:

a plurality of side wall panels hingedly connected to each other along generally vertical fold lines, each of said plurality of side wall panels including opposing upper and lower edges, said plurality of side wall panels forming the plurality of side walls of the container, said plurality of side wall panels including a first side wall panel including a generally vertical edge interconnecting said upper and lower edges of said first side wall panel;

a top minor flap hingedly connected to said first side wall panel along the upper edge thereof;

a first spout-forming appendage extending from said top minor flap, said first spout-forming appendage including a backboard; and a second spout-forming appendage extending from said generally vertical edge of said first side wall panel, said second spout-forming appendage including a spout body panel and a pair of spout wing panels hingedly connected to opposing edges of said spout body panel, said spout body panel and said pair of spout wing panels forming the respective spout body and the pair of spout wings of the pour spout, said backboard partially overlapping said spout body panel in response to folding the blank to form the container.

* * * * *